US005996990A

United States Patent [19]

Kawashima

[11] Patent Number: 5,996,990

[45] Date of Patent: Dec. 7, 1999

[54] SHEET FEEDING APPARATUS

[75] Inventor: Yasuhiro Kawashima, Atsugi, Japan

[73] Assignee: Ricoh Company, Ltd., Tokyo, Japan

[21] Appl. No.: 08/955,137

[22] Filed: Oct. 21, 1997

[30] Foreign Application Priority Data

Nov. 5, 1996 [JP] Japan ..... 8-292766
Jun. 19, 1997 [JP] Japan ..... 9-162625

[51] Int. Cl.[6] ..... B65H 3/52
[52] U.S. Cl. ..... 271/122; 271/125
[58] Field of Search ..... 271/10, 13, 116, 271/122, 125

[56] References Cited

U.S. PATENT DOCUMENTS

| | | | |
|---|---|---|---|
| 4,801,134 | 1/1989 | Yokoyama et al. | 271/122 |
| 5,039,080 | 8/1991 | Kato et al. | 271/122 |
| 5,050,854 | 9/1991 | Tajima | 271/122 |
| 5,564,689 | 10/1996 | Fukube | 271/122 |

FOREIGN PATENT DOCUMENTS

| | | | |
|---|---|---|---|
| 403073733A | 3/1991 | Japan | 271/122 |
| 403256944A | 11/1991 | Japan | 271/122 |
| 405097263A | 4/1993 | Japan | 271/122 |
| 6-87348 | 12/1994 | Japan . | |

*Primary Examiner*—H. Grant Skaggs
*Attorney, Agent, or Firm*—Oblon, Spivak, McClelland, Maier & Neustadt, P.C.

[57] ABSTRACT

A sheet feeding apparatus which includes a sheet holder holding at least one sheet to be fed. A pick-up roller feeds the at least one sheet from the sheet holder in a sheet feeding direction. A separating roller is provided at a lower reach of the pick-up roller. This separating roller receives a reverse torque in an opposite direction of the sheet feeding direction through a torque limiter. A feeding roller is provided opposite the separating roller and feeds the at least one sheet from the pick-up roller in the sheet feeding direction. Further, a frictional element is provided to increase a rotational load of the separating roller.

23 Claims, 5 Drawing Sheets

SHEET FEEDING APPARATUS

BACKGROUND OF THE INVENTION

1. Field of the Invention

The present invention generally relates to a sheet feeding apparatus equipped in a copier, facsimile, image-scanner, or similar equipment, for feeding original documents or recording sheets one by one.

2. Description of the Background Art

FIG. 1 is a cross-sectional view of a portion of a sheet feeding apparatus of a background art device which includes a separating roller 3. FIG. 2(*a*) is a perspective view of a supporting mechanism of the separating roller 3 of FIG. 1, and FIG. 2(*b*) is an exploded view of the separating roller 3. In FIG. 1, the sheet feeding apparatus includes a feeding tray 1 for holding a stack of recording sheets PP as a sheet locating portion, a press lever (not shown) for pressing a top of the stack of recording sheets PP toward the tray 1, arranged above the tray 1, and a stopper (not shown) for locating the sheets PP at a predetermined loading position on the tray 1.

In addition, the sheet feeding apparatus includes a pick-up roller 2 contacting the top of the stack of sheets PP to pick-up a topmost sheet P. The pick-up roller 2 may be formed of, for example, a circular or non-circular shaped roller, an eccentric roller, a non-circular eccentric roller, a circular or non-circular shaped roller with a frictional member wound along a rim, etc. The type of pick-up roller is chosen in relation to a structure of the loading portion. As another type of loading portion, a sheet feeding cassette is disclosed in Japanese Laid-Open Utility Model Application No. 06-87348.

Furthermore, the sheet feeding apparatus of FIG. 1 includes a separating roller 3 arranged at a lower reach of the pick-up roller 2 and a feeding roller 10 arranged at an opposite position to the separating roller 3. The feeding roller 10 is rotated by a feeding torque in a sheet feeding direction.

Next, referring to FIG. 2(*a*), a mechanism for driving the separating roller 3 is described. The driving mechanism includes a driving shaft 4, a driving gear 5, a follow gear 8, and a torque limiter 9. These members act to transmit a rotational power to the separating roller 3 to rotate separating roller 3 in a reverse direction against a sheet feeding direction. Further, a bracket 6 is movably supported by the driving shaft 9, and supports the driving gear 5, the follow gear 8, the torque limiter 9, and the separating roller 3 using a follow shaft 7 as a center axis. A spring 11 pushes the bracket 6 toward the feeding roller 10, see FIG. 1.

Next, referring to FIGS. 2(*b*) and 3, a torque mechanism is described. As shown in FIG. 2(*b*) and FIG. 3, the following shaft 7 has a pin 7*a*, and the pin 7*a* is inserted into a gap of the follow gear 8 to mesh with the driving gear 5, for fixing each other. As shown in FIG. 3, the torque limiter 9 includes a follow part 9*b* and a driving part 9*a*, and when a torque greater than a predetermined upper limit acts between follow part 9*b* and driving part 9*a*, the follow part 9*b* slips against the driving part 9*a*. On the other hand, the driving part 9*a* is connected with the pin 7*a* and, therefore, the driving part 9*a* rotates with the shaft 7 integrally on all occasions. The separating roller 3 is connected and fixed with the follow part 9*b* in relation to a rotating direction. Therefore, when an acting torque between the follow part 9*b* and the driving part 9*a* is less than the upper limit, the separating roller 3, and the follow part 9*b* as an axis of the separating roller 3, integrally rotate with the driving part 9*a*, the follow shaft 7, and follow gear 8. On the other hand, when an acting torque is greater than the upper limit, the separating roller 3 and the follow part 9*b* can rotate independently.

Next, referring to FIGS. 1 to 4(*a*) and 4(*b*), a separating movement of a background sheet feeding apparatus is described.

To the begin with, stack of sheets PP is set on the feeding tray 1 and a tip of sheets PP is pushed on a stopper (not shown) so as to locate the sheets PP at a predetermined loading position. As the sheets PP are fed, a lever (not shown) presses and gives the sheets PP on the tray 1 a prefixed moving friction, and the stopper leaves from the tip of the sheets PP. Then, a motor (not shown) transmits a torque to the pick-up roller 2 via a clutch mechanism (not shown), which rotates the pick-up roller 2 exactly by one turn each one action. Thereafter, as shown in FIG. 1, the pick-up roller 2 rotates to feed a topmost sheet P of the stack of sheets PP, and at an infant phase, the pick-up roller 2 stops contacting a surface of the fed sheet P. In other words, the pick-up roller 2 contacts a surface of the topmost sheet P for only a part of a phase-section. In this operation, a power for feeding the topmost sheet P acts directly on the topmost sheet P. However, an indirect feeding force also acts on a lower second sheet or further sheets under the topmost sheet P by friction occurring between the topmost sheet P and the lower second and further sheets. As a result, one or some further sheet(s) below the topmost sheet P may be (are) pushed out and inserted to a nip portion between the feeding roller 10 and the separating roller 3. That is, an improper feeding of several sheets, rather than just the topmost sheet P, can occur.

A reverse torque transmitted from the driving shaft 4 causes the separating roller 3 to rotate in an opposite direction (e.g., counterclockwise) of the feeding direction via the torque limiter 9. On the other hand, a feeding torque transmitted from a motor causes the separating roller 3 to rotate in a feeding direction (e.g., clockwise) via the feeding roller 10.

When there is none or only one paper sheet between the separating roller 3 and the feeding roller 10, as shown in FIG. 4(*a*), since the feeding torque is relatively larger than the reverse torque, the separating roller 3 is rotated in a feeding direction subordinately by the feeding torque. That is to say, in the torque limiter 9, the follow part 9*b* is slipped against the driving part 9*a* so that the separating roller 3 rotates in a feeding direction (e.g., clockwise) as shown in FIG. 4(*a*).

On the other hand, when two or more sheets of paper P,PPP are at the nip between separating roller 3 and feeding roller 10, or when the separating roller 3 does not contact the feeding roller 10 altogether, as shown in FIG. 4(*b*) the feeding torque is relatively smaller than the reverse torque, and as a result, the separating roller 3 is rotated in a reverse direction (e.g., counterclockwise) against the feeding direction by the reverse torque. This results because friction occurring between the topmost sheet P and a second sheet PPP, which is smaller than a friction occurring between the top sheet P and the feeding roller 10, reduces a torque transmitted from the feeding roller 10 to the separating roller 3. Therefore, in the torque limiter 9, the follow part 9*b* rotates in a same direction with the driving part 9*a*.

Consequently, by this action, the sheet PPP is pushed back toward the feeding tray 1, and only the topmost sheet P is fed in the feeding direction.

In a sheet feeding and separating action mentioned above, in the first place, as shown in FIG. 4(*a*), a topmost sheet P is inserted and fed at the nip between the separating roller 3 and the feeding roller 10, and accordingly the separating roller 3 subordinately rotates in the feeding direction shown by F in FIG. 4(*a*). And then later, as shown in FIG. 4(*b*), the sheet PPP is inserted and fed by a frictional force between the sheet PPP and the sheet P. While there are at least two sheets between the nip, the separating roller 3 rotates in the reverse feeding direction shown by R in FIG. 4(*b*) and the separating roller 3 pushes back the sheet PPP to ensure proper feeding of only the topmost sheet P.

However, a drawback with this operation is that after the separating roller 3 pushes back the sheet PPP, the separating roller 3 starts to rotate in the feeding direction again, and the sheet PPP may then be fed in the feeding direction again during a conveyance of the sheet P. The separating roller 3, therefore, switches repeatedly between rotating in the feeding direction (e.g., clockwise) and the reverse feeding direction (e.g., counterclockwise) during conveyance of the sheet P. A torque reaction of this repeated switching action issues a shock and a vibration to the separating roller 3, and the shock and the vibration are propagated to the feeding roller 10 or the follow shaft 7, or the driving shaft 4, or the bracket 6, etc., and this results in mechanical noise. Further, a frequency of the vibration and a level of the noise increase with an increasing in a rotational speed of the separating roller 3. Especially, when the vibration-frequency approaches a resonance frequency region of the follow shaft 7, or bracket 6, etc., the noise is amplified by the resonance phenomenon. The shock, moreover, is increased with shortening of a period of the repeated action. In the other words, as a transitional period from a slipping condition to a following condition, or from a following to a slipping of the follow part 9*b* in regard to the driving part 9*a*, is shortened, a level of the shock increases.

Accordingly, it may become necessary to decrease the noise or the shock by making parts around the separating roller 3, such as the follow shaft 7, bracket 6, etc., of high stiffness-materials, or the torque limiter 9 may have a characteristic prolonging of the transitional period.

However, these measures have problems such that the sheet feeding apparatus then becomes expensive or complex.

SUMMARY OF THE INVENTION

Accordingly, it is one object of the present invention to provide a novel sheet feeding apparatus for feeding a sheet one by one that overcomes the above-mentioned disadvantages.

Another object of the present invention is to provide a novel sheet feeding apparatus for feeding a sheet one by one that overcomes the above-mentioned disadvantages without significantly increasing a cost.

The present invention achieves such objects by providing a novel sheet feeding apparatus which includes a sheet holder holding at least one sheet to be fed. A pick-up roller feeds the at least one sheet from the sheet holder in a sheet feeding direction. A separating roller is provided at a lower reach of the pick-up roller. This separating roller receives a reverse torque in an opposite direction of the sheet feeding direction through a torque limiter. A feeding roller is provided opposite the separating roller and feeds the at least one sheet from the pick-up roller in the sheet feeding direction. Further, a frictional element is provided to increase a rotational load of the separating roller.

The frictional element may contact at least one of the separating roller or an element rotating with the separating roller, e.g. the torque limiter, to thereby increase the rotational load on the separating roller. The frictional element may include a single frictional part, a frictional part fixed on an elastic plate, an additional seal part formed at edges of the frictional part, or a frictional layer and an elastic layer.

The above and other objects and novel feature of the invention will more fully appear from the following detailed description when the same is read in connection with the accompanying drawing. It is to be expressly understood, however, that the drawings are for purpose of illustration only and are not intended as a definition of the limits of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein;

FIG. 2(*b*) is an exploded view of the separating roller in FIG. 2(*a*);

FIG. 4(*b*) is a diagram showing an operation of the sheet feeding apparatus of FIG. 1;

DETAILED DESCRIPTION OF THE PREFERRED EMBODIMENTS

Figure 5:
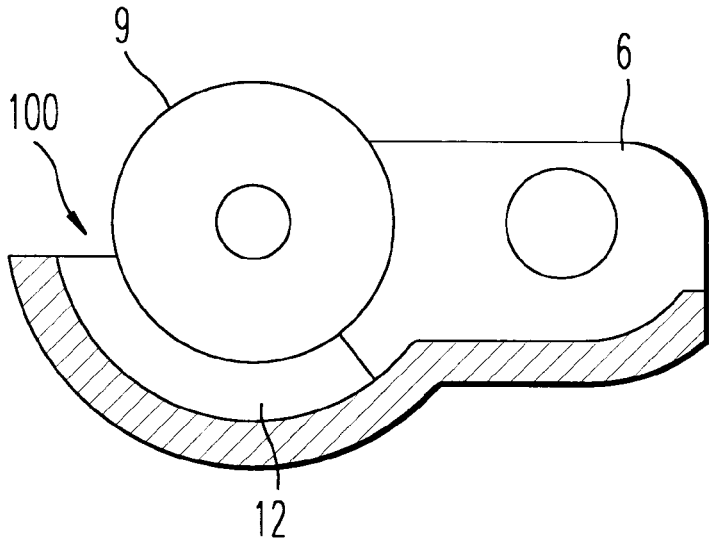
FIG. 5 is a cross-sectional view of a sheet feeding apparatus of a first embodiment of the present invention.

A description will now be given of a first embodiment of a sheet feeding apparatus according to the present invention. FIG. 5 is a cross-sectional view of a separating roller of a sheet feeding apparatus of the present invention.

This sheet feeding apparatus, as shown in FIG. 5, includes a bracket 6 and a torque limiter 9 as in the background art of FIGS. 1–4, and further includes a frictional element 100 including a frictional part 12.

The frictional part 12 is made of an elastic material such as sponge, urethane rubber, etc., and may be sheet shaped. The frictional part 12 is cemented to an inner surface of the bracket 6 opposing the torque limiter 9, and the torque limiter 9 pushes against the frictional part 12 from the follow shaft 7 as a center axis referring to a radius direction of the torque limiter 9. That is to say, the frictional part 12 pushes an outer surface of the torque limiter 9 through use of an elastic restoring power of the frictional part 12 itself. Since the elastic power of the frictional part 12, therefore, acts as a vertical reaction to an outer surface of the torque limiter 9, the frictional part 12 adds an almost uniform frictional force, which is in proportion with the vertical reaction, to the torque limiter 9, when the torque limiter 9 rotates.

The torque limiter 9 rotates under loaded conditions because of the frictional force exerted on the outer surface of the torque limiter 9 by the frictional part 12. This load, accordingly, acts to prolong the transitional period of a reverse action of the outer surface of the torque limiter 9, in other words, of the outer part 9*b*. That is to say, since the frictional part 12 increases the slipping period between the follow part 9*b* and driving part 9*a*, and dulls a response of the separating roller 3 when the follow part 9*b* turns over, a shock issued by a switching of a rotational direction of the follow part 9*b* is suppressed. Furthermore, since the frictional part 12 absorbs a vibration of the separating roller 3 or the bracket 6 due to its elastic characteristic, a decay time of the vibration or an amplification issued by a resonance of the bracket 6, etc., and thus level of noise, are decreased.

Accordingly, in this embodiment, reducing the vibration and the shock issued when the separating roller 3 switches rotational directions results in decreasing a rise of a level of noise with an increasing vibration-frequency, and decreases an amplified noise due to a resonance phenomenon. Accordingly, it is possible to restrain a cost of the feeding apparatus by a simply and inexpensive structure.

Figure 6:
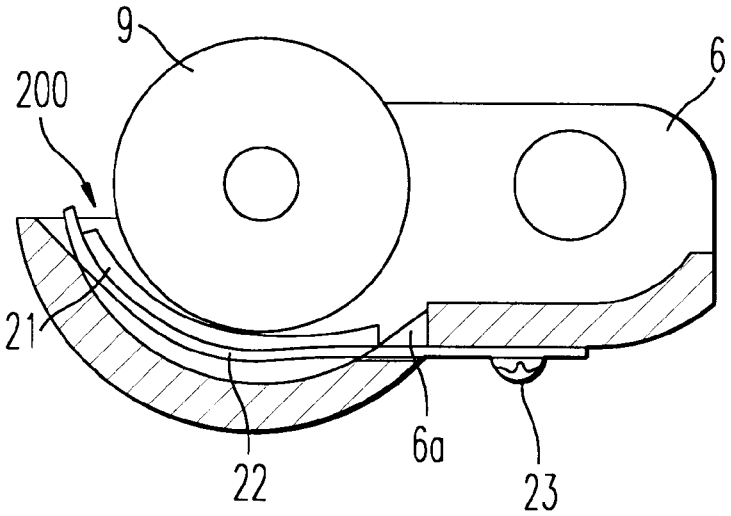
FIG. 6 is a cross-sectional view of a sheet feeding apparatus of a second embodiment of the present invention.

A description is now given of a second embodiment of a sheet feeding apparatus according to the present invention. FIG. 6 is a cross-sectional view of a separating roller of a sheet feeding apparatus of this second embodiment of the present invention.

Figure 1:
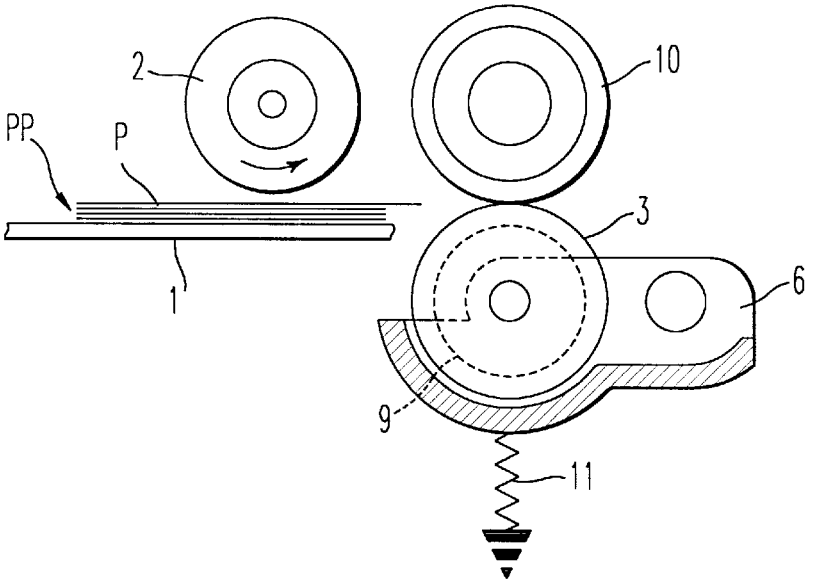
FIG. 1 is a cross-sectional view of a portion of a separating roller of a sheet feeding apparatus as background art.
Figure 2A:
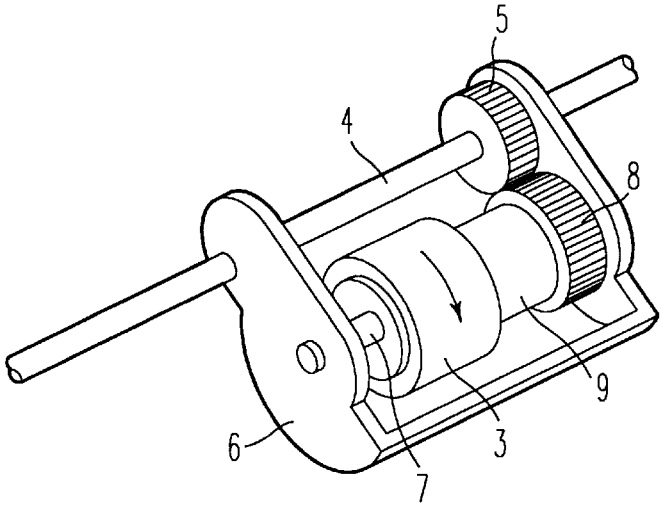
FIG. 2(*a*) is a perspective view of a supporting mechanism of a separating roller as background art.
Figure 2B:
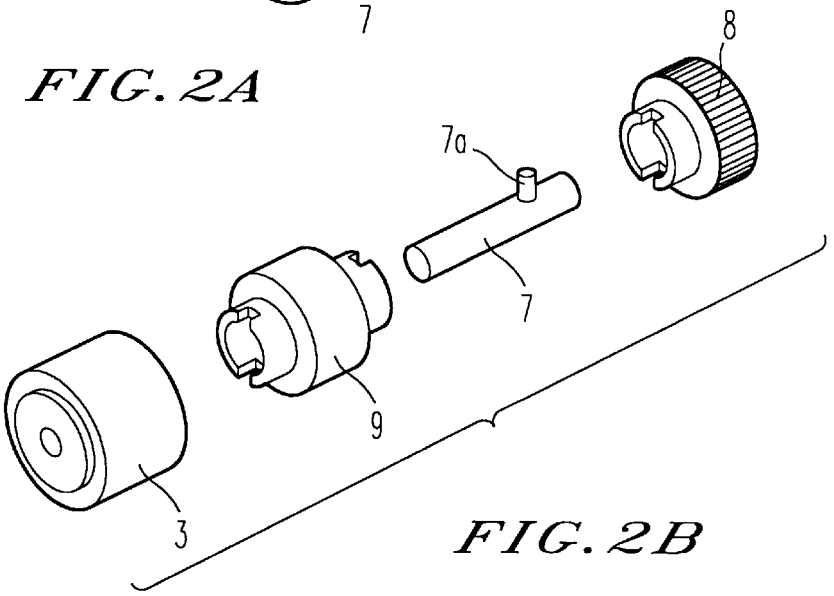
Figure 3:
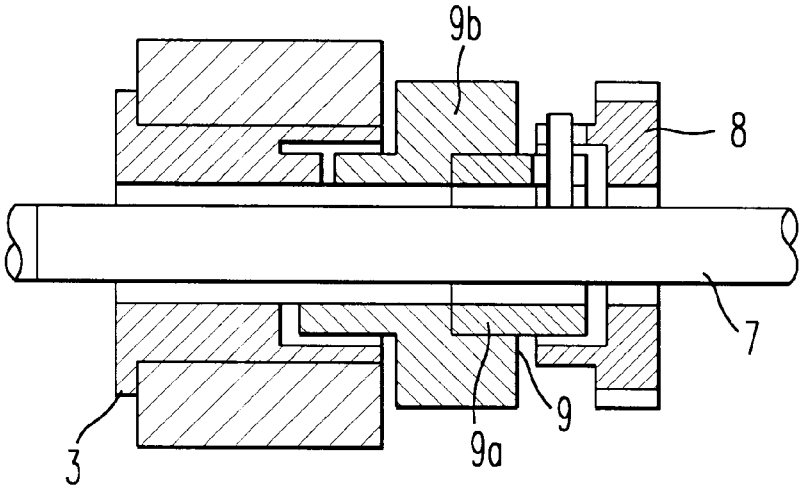
FIG. 3 is a cross-sectional view of the separating roller of FIG. 1 and other parts concerned with the separating roller.
Figure 4A:
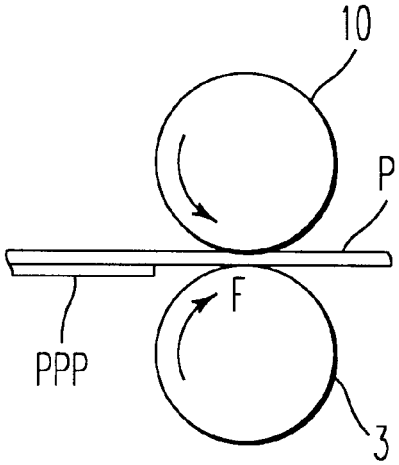
FIG. 4(*a*) is a diagram showing an operation of the sheet feeding apparatus of FIG. 1.
Figure 4B:
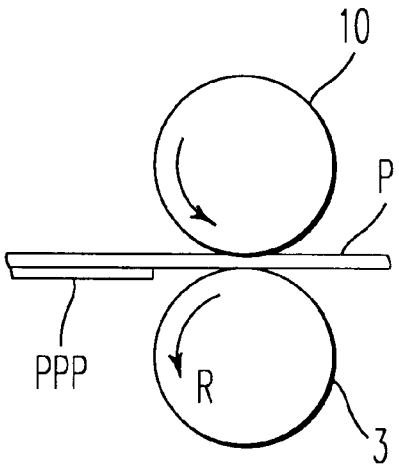

This sheet feeding apparatus of FIG. 6 is similar to the embodiment of FIG. 1, except that this second embodiment includes a frictional element 200 including a frictional part 21, and therefore an explanation is directed mainly to the frictional element 200.

The frictional part 21 is made of an elastic material such as felt, sponge, urethane rubber, etc., and may be sheet shaped. The frictional part 21 is cemented to a flexible part of a press plate 22, which has an elastic characteristic. Then, the press plate 22 is passed through a hole 6*a* provided in the bracket 6, and is connected to an outer surface of the bracket 6 by a screw 23 at a fixing position. The press plate 22 is bent from the follow shaft 7 as a center axis referring to a radius direction of the torque limiter 9, and pushes the frictional part 21 against an outer surface of the torque limiter 9 through the use of an elastic restoring power of the press plate 22 itself. Since the elastic power, therefore, acts as a vertical reaction to an outer surface of the torque limiter 9, the frictional part 21 adds an almost uniform frictional force, which is in proportion with the vertical reaction, to the torque limiter 9, when the torque limiter 9 rotates.

In this embodiment, even if there is an environmental, such as temperature or humidity, change, or there is quality change of a material of the frictional part 21 over time, a change of pressurization of the frictional part 21 against the torque limiter 9 is retarded in comparison with the first embodiment, and thus the same function of the first embodiment is maintained with stability over a longer term. Furthermore, in this second embodiment the frictional part 21 is not required to be made of an elastic material due to establishing of the press plate 22, and therefore it is possible to have a greater choice for the material of the frictional part 21. Furthermore, in comparison to a case of cementing a frictional element to the bracket 6 directly, in the second embodiment it is possible to attach or exchange the frictional element 200 from the bracket 6 easily.

Figure 7:
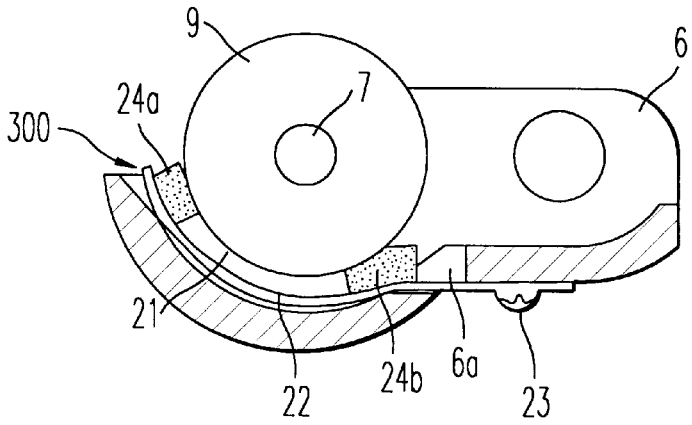
FIG. 7 is a cross-sectional view of a sheet feeding apparatus of a third embodiment of the present invention.
Figure 8:
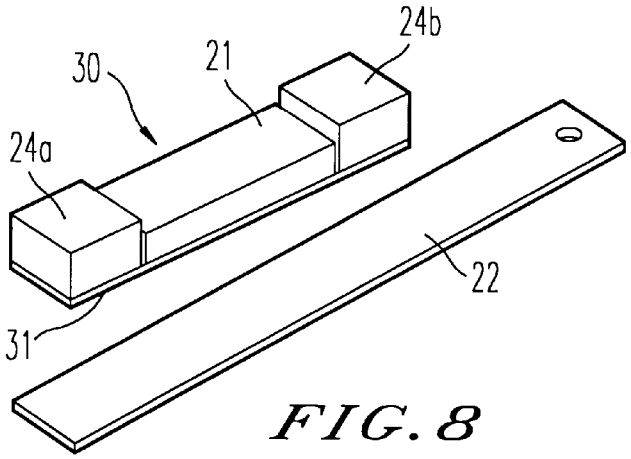
FIG. 8 is a diagram showing a modification of the third embodiment of FIG. 7.

A description is now given of a third embodiment of a sheet feeding apparatus according to the present invention with reference to FIG. 7 and FIG. 8.

FIG. 7 is a cross-sectional view of a separating roller of a sheet feeding apparatus according to the third embodiment.

This sheet feeding apparatus of FIG. 7 is similar to the second embodiment, except that this third embodiment includes a frictional element 300 including a frictional part 21, and therefore an explanation is directed mainly to the frictional element 300.

The frictional part 21 is made of an elastic material such as felt, sponge, urethane rubber, etc., and may be sheet shaped. The frictional part 21 is cemented to a flexible part of a press plate 22, which has an elastic characteristic.

Seal parts 24*a*, 24*b* are included and are made of a more elastic and softer material, e.g., sponge, and are thicker than the frictional part 21. The seal parts 24*a*, 24*b* are also cemented to the press plate 22 at both edges of the frictional part 22 in respect to a rotational direction of torque limiter 9. With respect to the axis direction, seal parts 24*a*, 24*b* may have a same length as the frictional part 22, or may have a greater length for the sake of covering frictional part 22.

The press plate 22 is, as noted in the second embodiment, passed through a hole 6*a* provided in the bracket 6, and is connected to an outer surface of the bracket 6 by a screw 23 at a fixing position. The press plate 22 is bent outward, and pushes the frictional part 21 against an outer surface of the torque limiter 9 through the use of an elastic restoring power of the press plate 22 itself. Further, the press plate 22 also pushes the seal parts 24*a*, 24*b* against the torque limiter 9, and brings the seal parts 24*a*, 24*b* into intimate contact with the outer surface of the torque limiter 9 along a width direction thereof, in order to prevent gaps between the torque limiter 9 and the seal parts 24*a*, 24*b* with a compressed deformation of the seal parts 24*a*, 24*b*.

In this embodiment, in addition to the functions achieved in the second embodiment, the seal parts 24*a*, 24*b* prevent a foreign body, such as paper powder, dust, etc., from invading between the torque limiter 9 and the frictional part 21. Accordingly, it is possible to further prevent a change of a rotational load due to such an invasion of a foreign body, and thereby a stable performance of the separating roller 3 can be maintained for a long time.

As a modification of this embodiment of FIG. 7, as shown in FIG. 8, a cartridge 30 including the seal parts 24*a*, 24*b* and the frictional part 21 may be attached onto a supporting board 31 by a bond such a double-sided cellophane tape, a screw, or glue. The cartridge 30 in turn may then be removably set on the press plate 22. In this structure, the cartridge 30 is treated as one body, and thereby its manufacturing ability is raised. Further, it is possible to change the cartridge 30 easily in a short time when cartridge 30 is periodically replaced with a new one as a consumable article.

Figure 9:
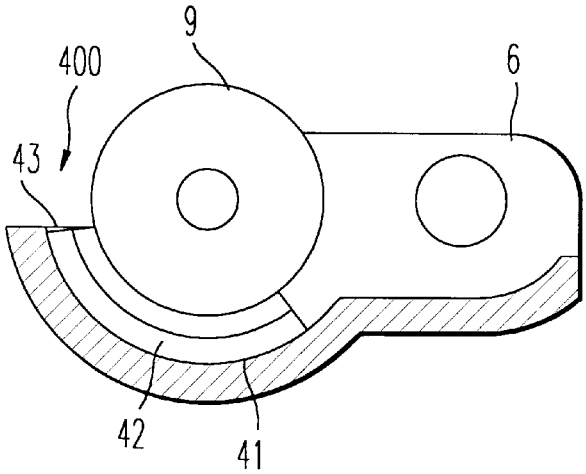
FIG. 9 is a cross-sectional view of a sheet feeding apparatus of a 4th embodiment of the present invention.

A description is now given of a fourth embodiment of a sheet feeding apparatus according to the present invention. FIG. 9 is a cross-sectional view of a separating roller of a sheet feeding apparatus of this fourth embodiment of the present invention.

This sheet feeding apparatus of FIG. 9 is similar to the embodiment of FIG. 1, except that this fourth embodiment includes a frictional element 400 including a frictional part 41, and therefore an explanation is directed mainly to the frictional element 400.

The frictional part 41 may be sheet shaped, and a reference numeral 42 indicates an elastic part, which may also be sheet shaped, and which is made of a high-porosity material such as sponge, urethane rubber, etc., having an ample elasticability. The frictional part 42 and elastic part 42 are fixed to each other by, as an example, glue, and form a laminated part 43.

The laminated part 43 is cemented to an inner surface of the bracket 6 opposing the torque limiter 9, and the elastic part 42 mainly pushes an outer surface of the torque limiter 9 through the use of an elastic restoring power of the elastic part 42 itself. Since the elastic restoring power, therefore, acts as a vertical reaction to the outer surface of the torque limiter 9, the elastic part 42 adds an almost uniform frictional force, which is in proportion with the vertical reaction, to the torque limiter 9, when the torque limiter 9 rotates.

In this embodiment, in addition to the functions achieved in the first embodiment, since the frictional part 41 is not required to be made of an elastical material due to utilizing the elastic part 42, it is possible to have a greater choice for a material of the frictional part 42 from among several alternatives, for example, from the view point of the cost, circulation, endurance, etc.

In the above-mentioned embodiments, it is explained that the frictional parts 12, 21, and 41 are positioned to contact the outer surface of the torque limiter 9. However, as for an element to be contacted by the frictional parts, it is essential only that the element rotate conformably with the separating roller 3 itself about the follow shaft 7. For example, it is possible to arrange the frictional parts to contact the separating roller 3 directly, or to contact both the separating roller 3 and the torque limiter 9, or to further add a ring-shaped part near the separating roller 3, which is fixed to rotate with the separating roller 3, and to then have the frictional part contact this further added ring-shaped part.

Figure 10:
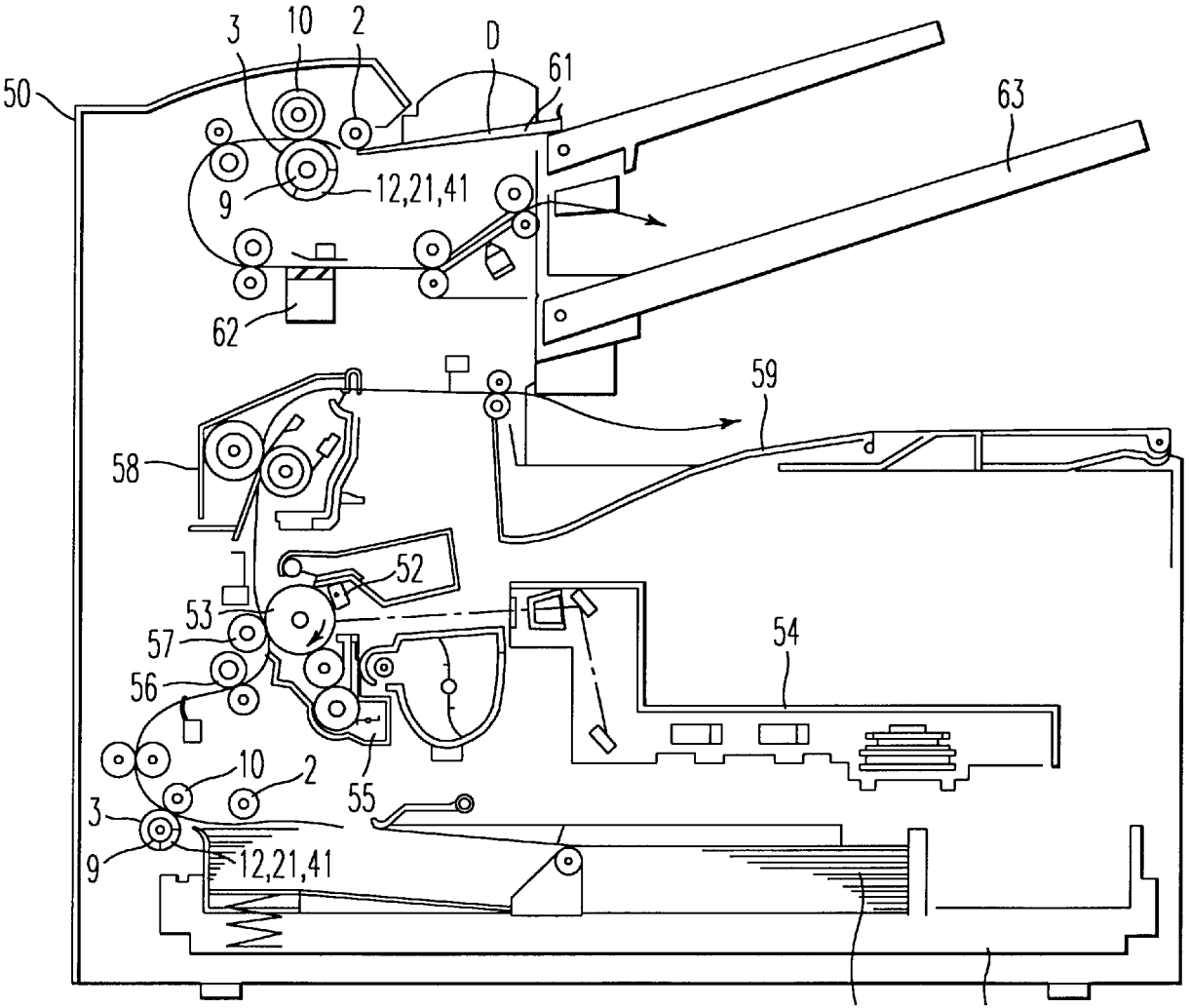
FIG. 10 is a cross-sectional side view of a facsimile machine having the sheet feeding apparatus in regard to the present invention.

Next, referring to FIG. 10, a description is now given of an imaging device which includes the sheet feeding apparatuses according to the present invention. FIG. 10 is a cross-sectional side view of such an imaging device.

The imaging device may be a facsimile machine which includes a main body 50, a paper feeding cassette 51 detachably provided in the main body 50 for holding a paper P, and on original feeding tray 61 for supporting original documents D. The tray 61 and cassette 51 each work as sheet holding devices of the sheet feeding apparatus.

Further, the facsimile machine includes a scanning section for reading an image on the original documents D, and an image recording section for recording the images on the paper sheets P. Furthermore, the sheet feeding apparatus in regard to the present invention is adopted in the image recording section and/or in the image scanning section for feeding the original documents D or the paper sheets P one by one from each holding device.

The recording section includes the sheet feeding apparatus having the separating roller 3, which has one of the above-mentioned frictional parts 12, 21 or 41, and a photosensitive drum 53 successively surrounded by a charger 52, a developing device 55, a transferring roller 57, and further includes an optical image writing unit 54 and fixing device 58. In such a construction, the charger 52 uniformly electrifies the photosensitive drum 53. Then, an electrostatic latent image formed on an outer surface of the photosensitive drum 53 by the optical image writing unit 54 is developed with the developing device 55 and a toner image is thereby formed. On the other hand, a paper sheet P as a recording medium is fed from the paper feeding cassette 51 to a pair of timing rollers 56, and is then fed one by one between the separating roller 3 and the feeding roller 10. Then, the paper sheet P is temporarily held by the timing roller 56, and is then fed between the photosensitive drum 53 and transferring roller 57 in synchronization with a movement of the photosensitive drum 53. Then, the toner image on the photosensitive drum 53 is transferred onto the paper sheet P by the transferring roller 57, and the paper sheet P is then passed through the fixing device 58, and the toner image is then fixed thereon by a pressure and a heat thereof. The paper sheet P with the fixed toner image is then discharged to a discharging tray 59.

Next, a description is given to the scanning section. The scanning section includes the sheet feeding apparatus having the separating roller 3, which has one of the above-mentioned frictional parts 12, 21 or 41, and a conveyance path having a U-shaped body, and an image reading unit 62 having a CCD (charge-coupled device) is provided within the conveyance path. In such a construction, the original documents D including images, which are fed one by one between the separating roller 3 and the feeding roller 10, are fed from the original feeding tray 61 to the image reading unit 62. Then, the images on the original documents D are scanned and read by the image reading unit 62, and data of the images are transferred to the image writing unit 54. The original documents D that have thus been scanned are then discharged to an original document discharging tray 63.

In the case of adopting the sheet feeding apparatus for feeding the recording paper sheet P one by one in the recording section of the present invention, since one of the frictional parts 12, 21 or 41 reduces a vibration and a shock issued when the separating roller 3 switches rotational directions, a level of noise with increasing vibration-frequency is reduced, and amplified-noise due to a resonance phenomenon is reduced. Thereby, with the structure of the present invention it is possible to prevent a serious vibration from transferring to the recording paper sheet P when the toner image is transferred from the photosensitive drum 53 to the paper sheet P. Accordingly, an occurrence of image deflection on the paper sheet P or a flaking off of the toner from the paper sheet P due to such vibrations is prevented.

On the other hand, in the case of adopting the sheet feeding apparatus for feeding the original documents D one by one in the scanning section in the present invention, since one of the frictional parts 12, 21 or 41 reduces a vibration and a shock issued when the separating roller 3 switches rotational directions, a level of noise with increasing vibration-frequency is reduced, and amplified-noise due to a resonance phenomenon is reduced. Thereby, with the structure of the present invention it is possible to prevent a serious vibration from transferring to the original documents D when the images on the original documents D are scanned. Accordingly, an occurrence of image deflection in the scanned images due to such vibration is prevented.

Obviously, numerous additional modifications and variations of the present invention are possible in light of the above teachings. It is therefore to be understood that within the scope of the appended claims, the present invention may be practiced otherwise than as specifically described herein.

The present invention is based on Japanese Priority Documents 8-292766 and 9-162625, the contents of which are incorporated herein by reference.

What is claimed as new and is desired to be secured by Letters Patent of the United States is:

1. A sheet feeding apparatus comprising:

a sheet holder holding at least one sheet to be fed;

a pick-up roller feeding the at least one sheet to be fed from said sheet holder in a sheet feeding direction;

a separating roller provided at a lower reach of said pick-up roller, which receives a reverse torque in an opposite direction of said sheet feeding direction through a torque limiter;

a feeding roller provided opposite said separating roller feeding the at least one sheet from said pick-up roller in the sheet feeding direction; and a frictional element increasing a rotational load of said separating roller and having an elastic power which acts as a vertical reaction to an outer surface of said torque limiter.

2. A sheet feeding apparatus in accordance with claim 1, wherein said frictional element contacts at least one of the separating roller or an element rotating with the separating roller to increase the rotational load on the separating roller.

3. A sheet feeding apparatus in accordance with claim 2, wherein said frictional element comprises a frictional part fixed on an elastic plate, and wherein the elastic plate pushes the frictional part on at least a portion of the separating roller or the element rotating with the separating roller through an elasticity of the elastic plate.

4. A sheet feeding apparatus in accordance with claim 3, wherein said frictional element further comprises at least one seal part provided at one edge of the frictional part, and wherein the at least one seal part is pushed on at least a part of the separating roller or the element rotating with the separating roller by the elastic plate.

5. A sheet feeding apparatus in accordance with claim 4, wherein said frictional element and said at least one seal part are fixed on a common board, to form a detachable cartridge.

6. A sheet feeding apparatus in accordance with claim 2, wherein said frictional element comprises a frictional layer and an elastic layer supporting the frictional layer, the elastic layer pushing the frictional layer on at least a part of the separating roller or the element rotating with the separating roller through an elasticity of the elastic layer.

7. A sheet feeding apparatus in accordance with claim 2, wherein the frictional element contacts the torque limiter as the element rotating with the separating roller.

8. A sheet feeding apparatus comprising:

a sheet holding means for holding at least one sheet to be fed;

a pick-up roller means for feeding the at least one sheet to be fed from said sheet holding means in a sheet feeding direction;

a separating roller means provided at a lower reach of said pick-up roller means, for receiving a reverse torque in an opposite direction of said sheet feeding direction through a torque limiter means;

a feeding roller means provided opposite said separating roller means for feeding the at least one sheet from said pick-up roller means in the sheet feeding direction; and a frictional means for increasing a rotational load of said separating roller means and having an elastic power which acts as a vertical reaction to an outer surface of said torque limiter.

9. A sheet feeding apparatus in accordance with claim 8, wherein said frictional means contacts at least one of the separating roller means or a means rotating with the separating roller means to increase the rotational load on the separating roller means.

10. A sheet feeding apparatus in accordance with claim 9, wherein said frictional means comprises a frictional part means fixed on an elastic plate means, and wherein the elastic plate means pushes the frictional part means on at least a portion of the separating roller means or the means rotating with the separating roller means through an elasticity of the elastic plate means.

11. A sheet feeding apparatus in accordance with claim 10, wherein said frictional means further comprises at least one seal means provided at one edge of the frictional means, and wherein the at least one seal means is pushed on at least a part of the separating roller means or the means rotating with the separating roller means by the elastic plate means.

12. A sheet feeding apparatus in accordance with claim 1, wherein said frictional means and said at least one seal means are fixed on a common board, to form a detachable cartridge.

13. A sheet feeding apparatus in accordance with claim 9, wherein said frictional means comprises a frictional layer and an elastic layer supporting the frictional layer, the elastic layer pushing the frictional layer on at least a part of the separating roller means or the means rotating with the separating roller means through an elasticity of the elastic layer.

14. A sheet feeding apparatus in accordance with claim 9, wherein the frictional means contacts the torque limiter means as the element rotating with the separating roller means.

15. A sheet feeding apparatus comprising:

a sheet holder holding at least one sheet to be fed;

a pick-up roller feeding the at least one sheet to be fed from said sheet holder in a sheet feeding direction;

a separating roller provided at a lower reach of said pick-up roller, which receives a reverse torque in an opposite direction of said sheet feeding direction through a torque limiter;

a feeding roller provided opposite said separating roller feeding the at least one sheet from said pick-up roller in the sheet feeding direction; and a frictional element increasing a rotational load of said separating roller, wherein said frictional element contacts at least one of the separating roller or an element rotating with the separating roller to increase the rotational load on the separating roller, and wherein said frictional element comprises a friction part fixed on an elastic plate, and wherein the elastic plate pushes the frictional part on at least a portion of the separating roller on the element rotating with the separating roller through an elasticity of the elastic plate.

16. A sheet feeding apparatus in accordance with claim 15, wherein said frictional element further comprises at least one seal part provided at one edge of the frictional part, and wherein the at least one seal part is pushed on at least a part of the separating roller or the element rotating with the separating roller by the elastic plate.

17. A sheet feeding apparatus in accordance with claim 16, wherein said frictional element and said at least one seal part are fixed to a common board, to form a detachable cartridge.

18. A sheet feeding apparatus comprising:

a sheet holder holding at least one sheet to be fed;

a pick-up roller feeding the at least one sheet to be fed from said sheet holder in a sheet feeding direction;

a separating roller provided at a lower reach of said pick-up roller, which receives a reverse torque in an opposite direction of said sheet feeding direction through a torque limiter;

a feeding roller provided opposite said separating roller feeding the at least one sheet from said pick-up roller in the sheet feeding direction; and a frictional element increasing a rotational load of said separating roller, wherein said frictional element contacts at least one of the separating roller or an element rotating with the separating roller to increase the rotational load on the separating roller, and wherein said frictional element comprises a frictional layer and an elastic layer supporting the frictional layer, the elastic layer pushing the frictional layer on at least a part of the separating roller or the element rotating with the separating roller through an elasticity of the elastic layer.

19. A sheet feeding apparatus comprising:

a sheet holding means for holding at least one sheet to be fed;

a pick-up roller means for feeding the at least one sheet to be fed from said sheet holding means in a sheet feeding direction;

a separating roller means provided at a lower reach of said pick-up roller means, for receiving a reverse torque in an opposite direction of said sheet feeding direction through a torque limiter means;

a feeding roller means provided opposite said separating roller means for feeding the at least one sheet from said pick-up roller means in the sheet feeding direction; and a frictional means for increasing a rotational load of said separating roller means, wherein said frictional means contacts at least one of the separating roller means or a means rotating with the separating roller to increase the rotational load on the separating roller means, and wherein said frictional means comprises a frictional part means fixed to an elastic plate means, and wherein the elastic plate means pushes the frictional part means on at least a portion of the separating roller means or the means rotating with the separating roller means through an elasticity of the elastic plate means.

20. A sheet feeding apparatus in accordance with claim 19, wherein said frictional means further comprises at least one seal means provided at one edge of the frictional means, and wherein the at least one seal means is pushed on at least a part of the separating roller means or the means rotating with the separating roller means by the elastic plate means.

21. A sheet feeding apparatus in accordance with claim 20, wherein said frictional means and said at least one seal means are fixed on a common board, to form a detachable cartridge.

22. A sheet feeding apparatus comprising:

a sheet holding means for holding at least one sheet to be fed;

a pick-up roller means for feeding the at least one sheet to be fed from said sheet holding means in a sheet feeding direction;

a separating roller means provided at a lower reach of said pick-up roller means, for receiving a reverse torque in an opposite direction of said sheet feeding direction through a torque limiter means;

a feeding roller means provided opposite said separating roller means for feeding the at least one sheet from said pick-up roller means in the sheet feeding direction; and a frictional means for increasing a rotational load of said separating roller means, wherein said frictional means contacts at least one of the separating roller means or a means rotating with the separating roller to increase the rotational load on the separating roller means, and wherein said frictional means comprises a frictional layer and an elastic layer supporting the frictional layer, the elastic layer pushing the frictional layer on at least a part of the separating roller means or the means rotating with the separating roller means through an elasticity of the elastic layer.

23. A sheet feeding apparatus comprising:

a sheet holder holding at least one sheet to be fed;

a pick-up roller feeding the at least one sheet to be fed from said sheet holder in a sheet feeding direction;

a separating roller provided at a lower reach of said pick-up roller, which receives a reverse torque in an opposite direction of said sheet feeding direction through a torque limiter;

a feeding roller provided opposite said separating roller feeding the at least one sheet from said pick-up roller in the sheet feeding direction; and a frictional element for producing friction to said separating roller so that vibration generated by repeated switching action of said separating roller is reduced.

* * * * *